United States Patent [19]

Tone

[11] Patent Number: 4,730,450

[45] Date of Patent: Mar. 15, 1988

[54] BOBBIN SUPPLYING SYSTEM IN SPINNING WINDER

[75] Inventor: Shoichi Tone, Kyoto, Japan

[73] Assignee: Murata Kikai Kabushiki Kaisha, Kyoto, Japan

[21] Appl. No.: 902,503

[22] Filed: Sep. 2, 1986

[30] Foreign Application Priority Data

Sep. 3, 1985 [JP] Japan ..... 60-194479

[51] Int. Cl.[4] ..... D01H 9/18; D01H 9/00

[52] U.S. Cl. ..... 57/281; 242/35.5 R

[58] Field of Search ..... 57/266, 270, 271, 281, 57/276, 90; 242/35.5 R

[56] References Cited

U.S. PATENT DOCUMENTS

| | | | |
|---|---|---|---|
| 4,023,338 | 5/1977 | Tooka et al. | 57/281 X |
| 4,181,228 | 1/1980 | Hashimoto et al. | 57/281 X |
| 4,566,263 | 1/1986 | Miyazaki et al. | 57/281 X |

*Primary Examiner*—Donald Watkins

*Attorney, Agent, or Firm*—Spensley Horn Jubas & Lubitz

[57] ABSTRACT

In a spinning winder wherein a winder and a spinning machine are connected by a bobbin transporting passage, spinning bobbins are alternately supplied from R side and L side transport bands of the spinning machine to a bobbin supplying station disposed between the winder and the spinning machine according to a spinning bobbin demand signal.

19 Claims, 11 Drawing Figures

BOBBIN SUPPLYING SYSTEM IN SPINNING WINDER

BACKGROUND OF THE INVENTION

1. Field of the Invention

The present invention relates to a system for supplying and transporting spinning bobbins doffed by an auto-doffer of a spinning machine to a winder connected to the spinning machine by means of transporting means.

2. Description of the Related Art

In spinning machines, particularly ring spinning machines, a number of spinning spindle units are juxaposed in a longitudinal direction in back-to-back relation on opposite sides of the machine bed. In such spinning machines, a transport band is rotatably disposed along each unit, a doffed spinning bobbin is automatically attached to a peg on the transport band, and as the band rotates in a first direction, the spinning bobbin fals into a bobbin box for driving it away. The bobbin box filled with spinning bobbins is transported toward the winder by transport means such as a bogie, a conveyor, etc., and then successively supplied to an automatic bobbin supplying device.

While such a system is suitable for producing yarns of the same kind in large volume, there involves a disadvantage in that since spinning bobbins are transported being encased at random in the box, the surface of a yarn layer gets out of shape or a large amount of fluffs occurs.

On the other hand, different from such a transporting system as described above, a so-called spinning winder wherein a spinning machine and a winder are connected by a bobbin transporting passage has been proposed and actually operated as a system suitable for production of those of various kinds of yarns but a small amount.

In such a case as described above, a problem lies in that an ability for processing yarns by the winder and an ability for supplying spinning bobbins driven away from the spinning machine have to be balanced and connected. When the spinning bobbin drive-away speed on the spinning machine side is lower than the bobbin consuming speed of the winder, the winder has to wait before it starts its operation.

Accordingly, in view of the balance of the processing ability, if the number of winding units of the winder is set according to the drive-away speed on the spinning machine side, the balance is obtained. However, it takes time for actual processing, and as a result, the production efficiency of the winder is deteriorated.

On the other hand, there is a type in which on the spinning machine side is provided the aforesaid transport bands on opposite sides of the machine bed, and in one transport band, spinning bobbins are driven away one by one from the end of the transport band by unidirectional intermittent rotation, and empty bobbins are attached to the band at the other end to simultaneously effect driving-away of spinning bobbins and supplying of empty bobbins. In such a case, supplying of empty bobbins to the transport band is effected while the transport band stops. Thus, the spinning bobbin driving-away ability is governed by the empty bobbin supplying ability Assuming now that in FIG. 10, the distance between pegs of the transport band, namely, the moving time of one pitch is t1 second and the time during which the band stops for supplying empty bobbins is t2 seconds, it takes (t1+t2) seconds to complete supplying of one empty bobbin. Spinning bobbins are driven away in the ratio of one during the t1 second. During the time (t2) the band remains stopped, and spinning bobbins are not driven away. Accordingly, in the spinning machine which is provided with the n-number of spinning units on one side, it takes at least $(t1+t2)\times n$ seconds to drive away the n number of spinning bobbins, and the spinning bobbin supplying ability per minute is $(60/(t1+t2)$ bobbins.

Since there are the n number of spinning units on the other side of the spinning machine, in the type in which spinning bobbins on the band on the other side are driven away after the spinning bobbins on the transport band on one side have been driven away, it totally takes $(t1+t2)\times 2n$ seconds, and the supplying ability per minute is the same as above. More specifically, the supplying ability of the spinning bobbins to the winder in the aforesaid case is determined according to the supplying ability for supplying empty bobbins to the transport band. Only the spinning bobbin supplying speed cannot be increased and is limited. This involved a problem that the ability of the winder cannot be fully utilized in the case where the winder is connected to the existing spinning machine despite the appearance of a high-speed winder.

OBJECT AND SUMMARY OF THE INVENTION

It is an object of the present invention to propose a bobbin supplying system in which spinning bobbins produced in a spinning frame may be alternately supplied from R and L sides of the spinning frame to a winder.

According to the preferred embodiment of the present invention, in a spinning winder wherein a winder and a spinning machine are connected by a bobbin transporting passage, spinning bobbins are alternately supplied from the R side and L side of the spinning machine to a bobbin receiving station on the winder side according to a spinning bobbin demand signal from the winder side.

When the winder side provides a bobbin demand signal, one spinning bobbin is driven away from the transport band side on one side (for example, R side). Then, when a succeeding bobbin demand signal is provided, a further spinning bobbin is supplied from the transport band side on the other side (L side). During that period, empty bobbins are supplied to predetermined pegs at the rearmost portion of the band on the R side. Accordingly, the spinning bobbins are successively driven away from the R and L sides, and the bobbins are successively supplied toward the winder at short pitch intervals.

DETAILED DESCRIPTION OF PREFERRED EMBODIMENT

In the following, the embodiment of the present invention will be described with reference to the drawings.

Figure 2:
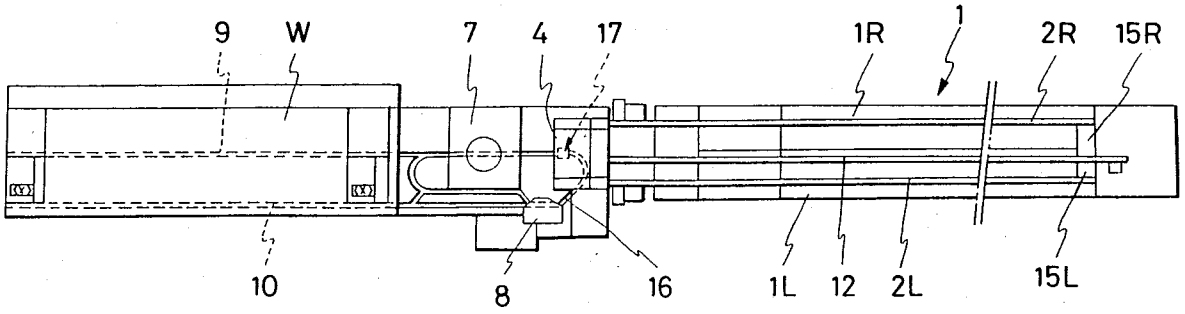
FIG. 2 is a plan view thereof.
Figure 1:
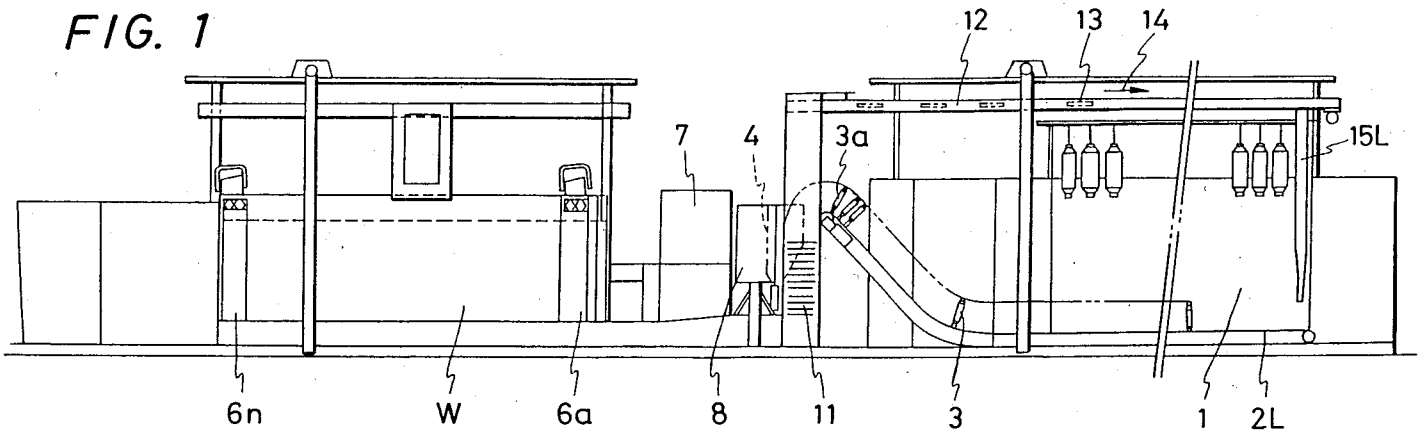
FIG. 1 is a schematic structural front view showing one example of a spinning winder.

FIGS. 1 and 2 show one example of a spinning winder. A spinning machine 1 comprises a machine bed on the R side (1R) and a machine bed on the L side (1L), which are provided back-to-back to constitute one spinning machine. For example, spinning bobbins 3 produced on the L-side machine bed (1L) are inserted into bobbin supporting pegs on a transport band (2L) by a known autodoffer, and transported lengthwise of the spinning machine 1. The spinning bobbins 3 are intermittently charged one by one into a bobbin supplying device 4 on the winder W side from the inclined end of the band (2L). The bobbins 3 are stood upright on trays with a peg (FIG. 4 (5)) transported on a bobbin transporting medium, namely, a belt conveyor which awaits at the lower portion and supplied through a reading device 7 to winding units *6a–6n* which constitute the winder W.

Supplying of bobbins to the winding units may be carried out by various methods. In the illustrated embodiment, the bobbins are supplied, while being held on the trays, from a spinning bobbin transporting conveyor 9 to the winding positions of the units individually. Empty bobbins which have been wound or bobbins with remaining yarns are transported, while being held on the trays, by a return conveyor 10 laid along the winder. The empty bobbins and the bobbins with remaining yarns are selected by a bobbin pull-out device 8. The empty bobbins 13 pulled out of the peg trays by the pull-out device 8 are transported upwardly by an empty bobbin lift device 11 and then transported horizontally in a direction as indicated by arrow 14 by a belt conveyor 12 extending above the spinning machine in a longitudinal direction. The empty bobbins 13 transported to the end of the spinning machine are distributed to the R side and to the L side, and fallen or stored into chutes 15R and 15L. The bobbins are then supplied to and disposed on empty pegs on the band 2L with a timing relative to the rotation of the transport band which will be described later.

On the other hand, in the winder region, the empty trays 5 from which the empty bobbins are removed by the bobbin pull-out device 8 are further transported on the conveyor 16 to a spinning bobbin supplying station 17 for receiving a supply of new spinning bobbins.

While in the above-described embodiment, the winder has been described for its type in which each unit is not provided with a magazine, it is of course noted that to the spinning machine may be connected a winder of the type in which each unit is provided with a magazine for storing a plurality of spinning bobbins, and the spinning bobbins transported on a spinning bobbin transporting conveyor laid along the winder are selected and supplied to the magazines.

Figure 3:
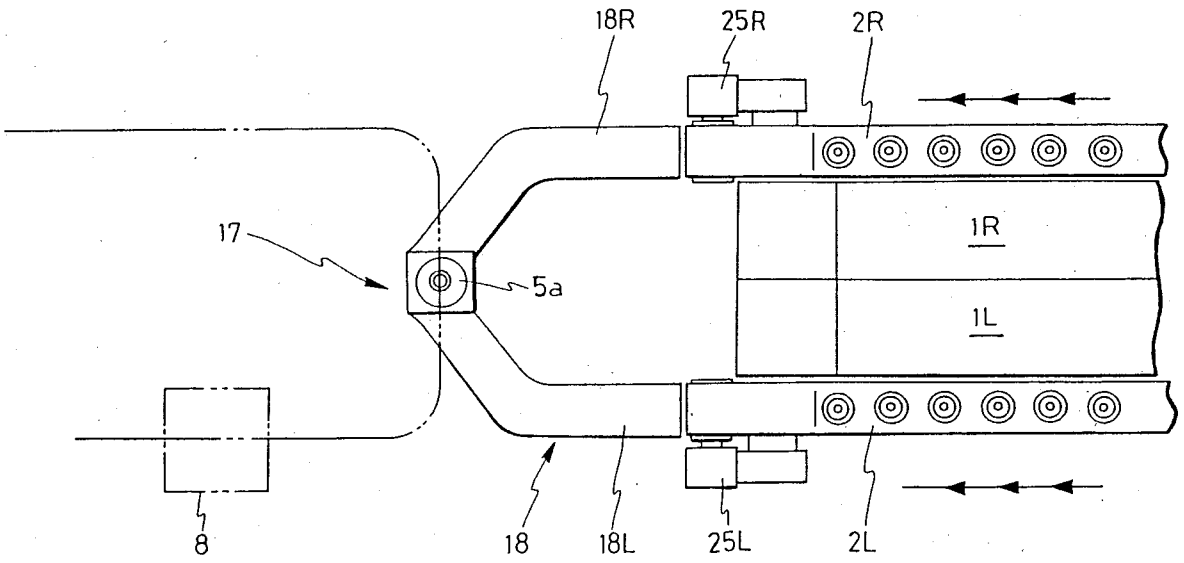
FIG. 3 is a plan view for explanation of an embodiment of a spinning bobbin supplying system.
Figure 4:
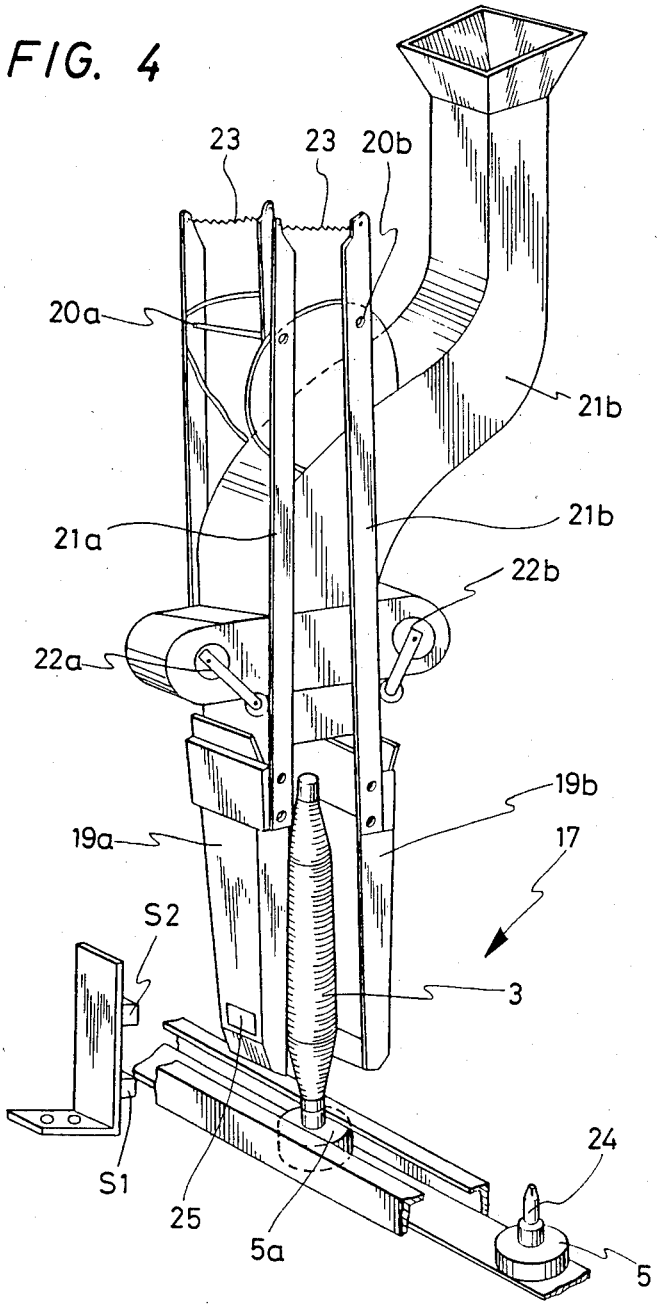
FIG. 4 is a perspective view showing one example of a spinning bobbin supplying station.

FIGS. 3 and 4 show one example of a spinning bobbin supplying station for supplying spinning bobbins from a transport band toward a winder. More specifically, the station 17 comprises a sensor S1 for detecting an arrival of the tray 5, a Y-shaped chute 18 for receiving spinning bobbins driven away from the transport band, movable guides *19a* and *19b* for guiding the spinning bobbins to the peg position of the tray at a lower level, and the like.

The guides *19a* and *19b* are mounted on levers *21a* and *21b* which pivotally move about support shafts *20a* and *20b*. The guides *19a* and *19b* are closed by actuation of rotary solenoids *22a* and *22b* and are opened by means of a spring 23. More specifically, normally the guides *19a l and 19b* are in open position to wait an arrival of a tray, are closed when the spinning bobbin is supplied to and disposed on the empty tray, and again opened after the bobbin has been disposed. The tray *5a* with the spinning bobbin 3 disposed thereon is released by a releasing mechanism not shown and transported toward the readying device 7 of the winder.

The sensor S1 detects the arrival of a tray whereas the sensor S2 detects the presence or absence of an empty bobbin or a bobbin with a remaining yarn on the tray. The sensor S1 is provided at a position where light is irradiated on a part of the tray *5a*. The sensor S2 is provided at a position above the sensor S1, above a peg 24 of a tray stopped at a predetermined position and where light is irradiated on a center line of the tray. A reference numeral 25 designates a light passing window of the sensor S2.

Accordingly, a bobbin demand signal is fed to the spinning machine according to AND of a signal by which the sensor S2 has detected the absence of bobbin and a signal by which the sensor S1 has detected the presence of a tray.

Next, a method for driving away spinning bobbins on the transport band according to the spinning bobbin demand signal will be described. In the transport bands 2R and 2L on R and L sides, respectively, band driving motors 25R and 25L are provided as shown in FIG. 3. Conveniently, the bands 2R and 2L are independently rotatable.

Figure 5:
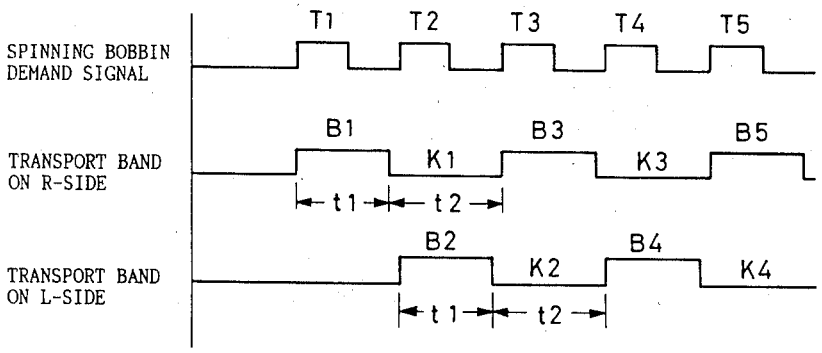
FIG. 5 is a time chart showing the relationship between the spinning bobbin demand signal and the transport band driving.

FIG. 5 shows an embodiment of a spinning bobbin supplying system. That is, spinning bobbin demand signals T1, T2 . . . Tn resulting from the arrival of empty trays at the bobbin supplying station are fed to the spinning machine. The R-side transport band 2R is rotated by 1 pitch at the time (t1) by the demand signal T1, during the period of which the uppermost bobbin (FIG. 1, (*3a*)) on the band is fallen and supplied into chute 18R shown in FIG. 3 and disposed on the tray. Thereafter, the R-side transport band 2R stops during the time (t2), and an empty bobbin K1 is supplied from the chute 15R in FIGS. 1 and 2 to an empty peg on the band.

A tray which received a supply of a further spinning bobbin B1 is delivered from the station 17. Upon arrival of a next empty tray, a next bobbin demand signal T2 is fed to the spinning machine whereby the L-side transport band 2L rotates by one pitch (t1) and stops (t2). Thereby, one spinning bobbin B2 on the L-side band is supplied to the tray in a manner similar to that described above, and one empty bobbin K2 is supplied to a rear empty peg on the L-side transport band.

Figure 10:
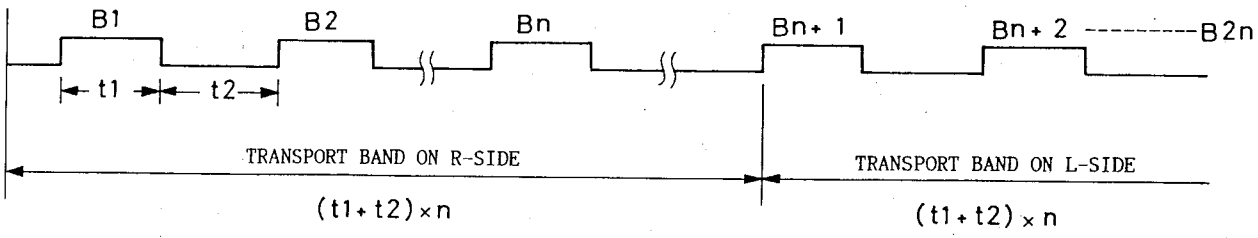
FIG. 10 is a time chart showing a conventional spinning bobbin supplying operation.

In this way, the R-side and L-side transport bands 2R and 2L are alternately driven by the succeeding bobbin demand signals T3 and T4 and the spinning bobbins are alternately supplied from the bands 2R and 2L. Thus, during the driving of the band on one side, the band on the other side stops without fail, during the period of which an empty bobbin may be received, and both driving away of spinning bobbins and receiving of empty bobbins are alternately carried out on the R-side and L-side. Thus, assuming that the bobbin demand signals are fed substantially regularly and periodically, the time required to drive away all the spinning bobbins 2n on the R and L sides of the spinning machine is approximately $(t1+t2)\times n$. That is, the spinning bobbin supplying ability is twice of the prior case shown in FIG. 10.

Figure 5A:
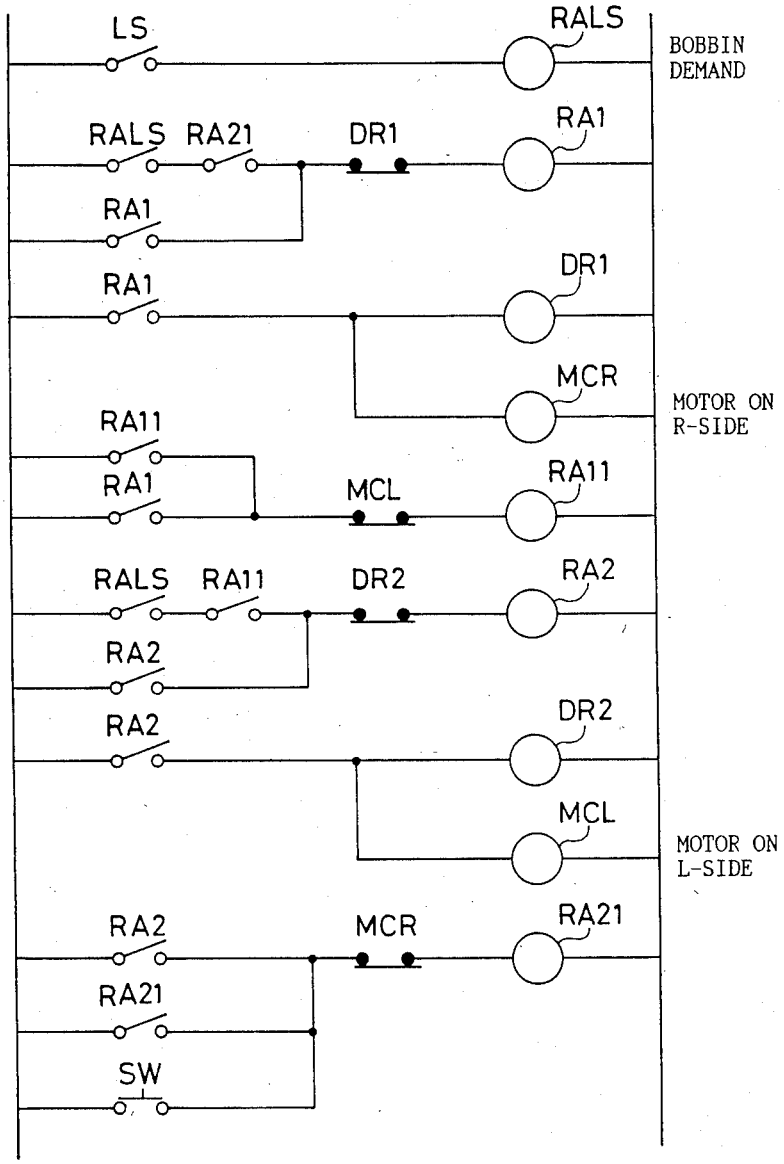
FIG. 5A is a relay circuit showing one example of a circuit for embodying the supplying method.

One example of a circuit diagram of a system for alternately supplying bobbins as described above is shown in FIG. 5A.

Switch SW confirms that doffing at the R and L side machine beds of the spinning machine has been completed and the spinning bobbins are transferred onto the R and L side transport bands 2R and 2L. When the switch SW is momentarily closed, relay RA21 is excited whereby a normally open contact RA21 in a self-retaining circuit and a normally open contact RA21 on the relay RA1 side are closed. Under this state, when a first empty tray arrives at the supplying station, a contact LS is closed by the bobbin demand signal and a relay RALS is excited. Thus normally open contact RALS on the relay RA1 side and normally open contact RALS on the relay RA2 side are closed but contact RA11 on the relay RA2 side remains open and therefore the relay RA1 is excited. By the excitement of the relay RA1, three normally open contacts RA1 are closed and a motor relay MCR for the R-side transport band is excited whereby the R-side motor is driven. By the excitement of the relay MCR, normally closed contact MCR is opened, relay RA21 is deenergized and contact RA21 on the relay RA1 side which has been closed is opened.

The motor stops when a timer relay DR1 is excited. In the illustrated embodiment, this is a t1 second timer relay as shown in FIG. 5. Thus, after t1 second, timer contact DR1 is opened, and relay RA1 is deenergized whereby the R-side motor stops and one spinning bobbin B1 is supplied from the R-side transport band.

A tray carrying the spinning bobbin B1 thereon is delivered from the supplying station, and when a succeeding new empty tray T2 arrives, a bobbin demand signal is again provided to excite the relay RALS. At that time, the normally open contact RA21 on the relay RA1 side has been opened and the contact RA11 on the realy RA2 side has been closed. Therefore, when a bobbin demand signal T2 is provided, the relay RA2 is excited. It is noted that the contact RA11 on the relay RA2 side has been closed by the relay RA11 excited by the normally closed contact MCL on the relay RA1 side at the previous bobbin demand signal.

By the excitement of the relay RA2, three normally open contacts RA2 are closed, the relay MCL for the L-side motor is excited, the L-side motor is driven, and a second spinning bobbin B2 is supplied to a tray T2.

Since the normally closed contact MCL on the realy RA11 side is opened by the excitement of the motor relay MCL, the relay RA11 opens and the contact RA11 which has been closed opens. After the lapse of the time t1 second, the timer relay DR2 is excited, the normally closed contact DR2 opens and the relay RA2 becomed deenergized. Therefore, three contacts RA2 which have been closed open and the motor stops.

Since the R-side motor relay MCR is in a state of deenergization during the driving of the L-side motor, the normally closed contact on the relay RA21 side closes, and during the driving of the L-side motor, the relay RA2 is excited and therefore the relay RA21 is again excited to form a self-retaining circuit whereby even if the relay RA2 is deenergized, the relay RA21 keeps excited and assumes a state before the original first bobbin demand signal is provided.

In this way, the spinning bobbins are supplied alternately from the R and L side transport bands every time a bobbin demand signal is provided.

Figure 6:
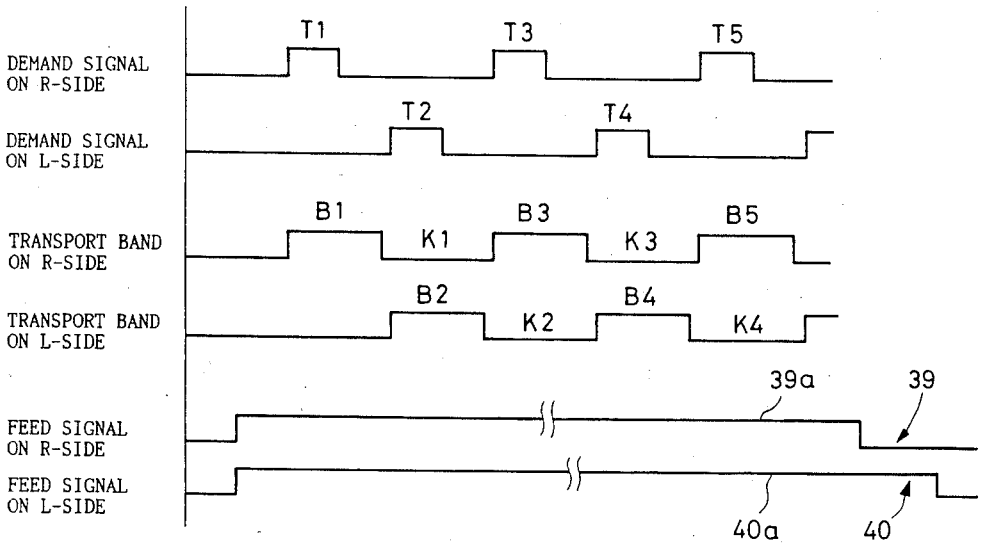
FIG. 6 is a time chart showing a further example of the spinning bobbin supplying method.

FIG. 6 shows a further embodiment of a bobbin supplying system. This is a system which provides spinning bobbin demand signals from the winder independently of R-side and L-side. When the R-side demand signal T1 is provided, the R-side transport band 2R rotates by one pitch to supply one spinning bobbin. When an empty tray arrives at the bobbin supplying station, the L-side demand signal T2 is provided and the L-side transport band 2L rotates by one pitch to supply one spinning bobbin.

Figure 7:
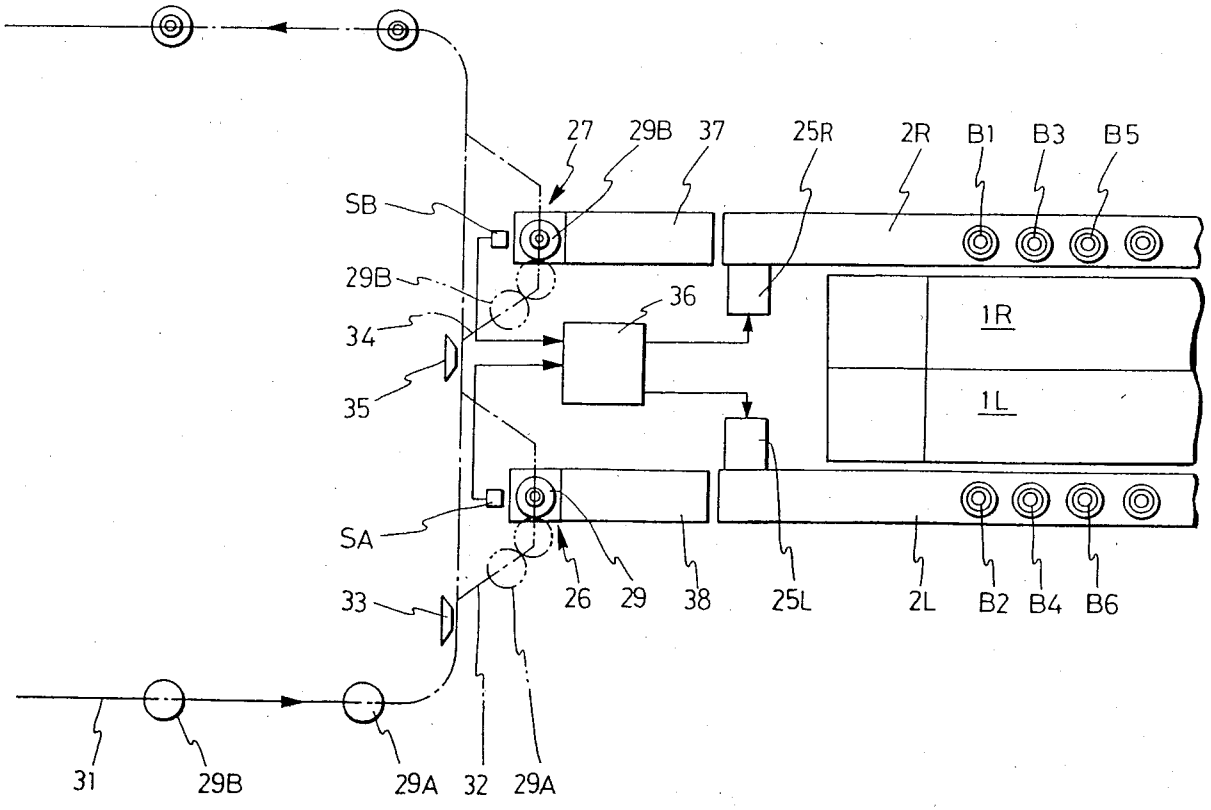
FIG. 7 is a plan view showing a further example of the spinning bobbin supplying station.

The case of such bobbin demand signal is advantageous for the case of FIG. 3 and for the case of FIG. 7 in which two bobbin supplying stations 26 and 27 are provided, and kinds of yarns produced on the R-side machine bed 1R and L-side machine bed 1L of the spinning machine 1 are different from each other. More specifically, trays 29A and 29B are previously applied with distinguishing marks according to kinds of bobbins inserted and stood thereon. The tray 29A for the bobbin B2 is selectively transported by a distinguishing device 33 on this side of a branch passage 32 of a transporting passage 31 whereas the tray 29B for the bobbin B1 is selectively transported by a distinguishing device 35 to a branch passage 34 and transported to bobbin supplying stations 26 an 27.

Accordingly, arrival signals of trays are provided from a tray arrival sensor SA of the station 26 and a tray arrival sensor SB of the station 27. When the signal is received by a controller 36, bobbin demand signals T1, T2 . . . as shown in FIG. 6 are produced so that motors 25R and 25L for driving the transport bands 2R and 2L are alternately driven, and bobbins B1, B3, B5 . . . of class B are supplied to the trays at that station through a chute 37 whereas bobbins B2, B4, B6 . . . of class A are supplied to the trays at that station through a chute 38.

Lines 39 and 40 denote signals from the spinning machine. During the presence of bobbins on the transport bands 2R and 2L on the R and L side machine beds, bobbin supplying signals 39*a* and 40*a* are provided, and only when bobbin demand signals T1 . . . Tn are provided during that period, the transport bands are rotated.

Figure 8:
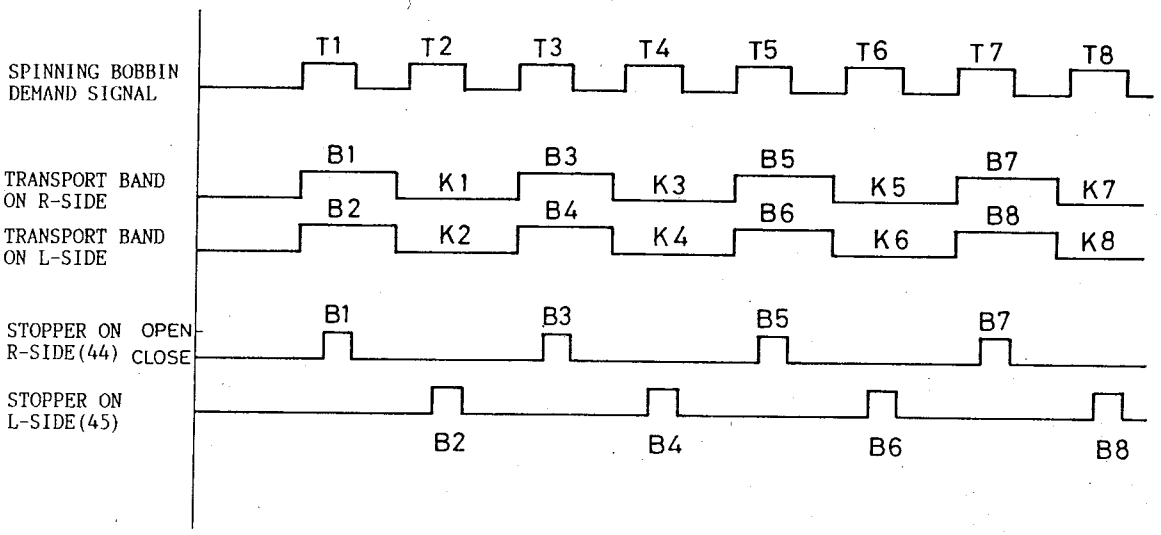
FIG. 8 is a time chart showing another example of the spinning bobbin supplying method.
Figure 9:
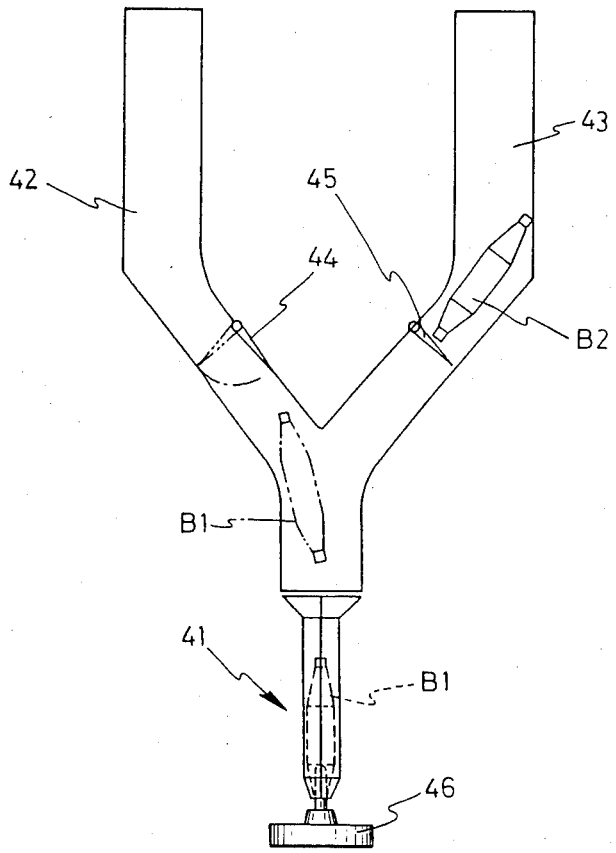
FIG. 9 is a side view showing an embodiment of the bobbin supplying station to which said time chart is applied.

While in the respective embodiments described above, the system has been illustrated in which the transport bands 2R and 2L are alternately driven to alternately supply bobbins from the R and L side machine beds, a further embodiment will be shown in FIGS. 8 and 9.

Referring to FIGS. 8 and 9, when bobbin demand signals T1, T2 . . . Tn are fed from the winder to the spining machine upon arrival of a tray at one bobbin supplying position 41, the transport bands 2R and 2L on the R and L sides are simultaneously driven by one pitch only at the time of demand signals T1, T3, T5 . . . among the bobbin demand signals to simultaneously release two bobbins B1 and B2 into the chute 1. Within the chute, movable stoppers 44 and 45 are provided in the midst of chutes 42 and 43 on the R and L sides as shown in FIG. 9, so that bobbins are once stopped, one bobbin B1 is supplied onto the tray 46 by the demand signal T1 and the succeeding bobbin demand signal T2 is provided. Then, the other stopper 45 is released and the bobbin B2 is supplied onto the tray. Accordingly, as shown in FIG. 8, the movable stoppers 44 and 45 are alternately opened and closed every bobbin demand signal to alternately supply spinning bobbins on the R and L side machine beds.

In an empty bobbin transporting passage (FIG. 1, (12)), where one kind of bobbins are handled as in the embodiments shown in FIGS. 3 and 9, one conveyor is installed, and movable guide plates for distribution to the R-side and L-side are provided at the chute position at the rear end of the spinning machine. The guide plates are controlled so that within the stopping time t2 of the transport band, empty bobbins are supplied to pegs on the band as mentioned above thereby alternately supplying the empty bobbins to the R-side and L-side.

Where two kinds of bobbins are handled as in the embodiment shown in FIG. 7, if a transporting passage for exclusive use for empty bobbins is provided, they may be supplied alternately to the transport bands on the R and L sides without confusing the kinds thereof.

As described above, according to the present invention, the spinning bobbins may be alternately supplied from the R and L sides to the winder. Where a conventional spinning machine and a high speed winder are connected, the spinning bobbin supplying ability may be increased to enhance the operating efficiency of the winder.

What is claimed is:

1. A spinning winder, comprising:

a winder having means for producing spinning bobbin demand signals;

a spinning machine, having a first and a second side and having a first machine bed on said first side and a second machine bed on said second side, providing spinning bobbins;

a bobbin transporting passage, connecting said winder with said spinning machine, said bobbin transporting passage having a bobbin supplying station;

a bobbin supplying system for repetitively, alternating the supplying of a single spinning bobin produced from said machine bed on said first side of said spinning machine with a single spinning bobbin produced from said machine bed on said second side of said spinning machine to said bobbin supplying station, in response to said spinning bobbin demand signals.

2. A spinning winder, comprising:

a spinning machine having a first machine bed and a second machine bed, for producing spinning bobbins;

a first transport band and a second transport band disposed adjacent said first and said second machine beds, respectively, said first and second transport bands having pegs for supporting bobbins thereon;

a winder having a plurality of winding units, operable for winding spinning bobbins and for discharging empty bobbins;

a bobbin transporting passage, provided adjacent the winding units, for transporting and supplying spinning bobbins to said winding units, said bobbin transporting passage having a portion thereof connected with said transport bands;

at least one bobbin supplying station disposed adjacent said portion of the bobbin transporting passage which is connected with the transport bands, and operable for supplying spinning bobbins to said bobbin transporting passage;

an empty bobbin feeding device for supplying empty bobbins discharged from the winding units onto the pegs of the transport bands; and a bobbin supplying system having a sensor disposed adjacent said at least one bobbin supplying station, for detecting the absence of a bobbin thereat and, in response thereto, for providing a spinning bobbin demand signal to the spinning machine, said bobbin supplying system further having drive means for driving said first and said second transport bands in response to the spinning bobbin demand signal so as to supply spinning bobbins from said transport bands to said at least one bobbin supplying station.

3. A spinning winder as claimed in claim 2, further comprising:

first supplying means, responsive to said bobbin demand signal, for repetitively alternating the supplying of a single spinning bobbin supported by said first transport band with a single spinning bobbin supported by said second transport band to said bobbin supplying station;

wherein said empty bobbin feeding device includes a second supplying means for supplying an empty bobbin to a peg of one of said transport bands simultaneously with the supplying, by said first supplying means, of a spinning bobbin from the other of said transport bands.

4. A spinning winder as claimed in claim 2, further comprising:

transporting mediums for supporting said spinning bobbins supplied to said winding units and for supporting said empty bobbins discharged from said winding units; and a pull-out device operable for removing empty bobbins from said transporting mediums and or supplying said empty bobbins to said empty bobbin feeding device.

5. A spinning winder as claimed in claim 4, further comprising:

distinguishing indicia provided on the transporting mediums; and distinguishing device for detecting the distinguishing indicia.

6. A spinning winder as claimed in claim 5, wherein said at least one bobbin supplying station comprises a bobbin supplying station provided for said first machine bed and a bobbin supplying station provided for said second machine bed, and said spinning bobbin demand signal is provided in response to the arrival of a transporting medium at either of said bobbin supplying stations.

7. A spinning winder as claimed in claim 2, further comprising:

a chute having a first branched chute connected with said first transport band and a second branched chute connected with said second transport band, for guiding bobbins therein, said chute provided adjacent said at least one bobbin supplying station; and movable stopper, associated with each of the branched chutes, operable for stopping bobbins guided in said branched chutes.

8. A spinning winder as claimed in claim 7, further comprising:

drive means for simultaneously driving said first transport band and said second transport band by one pitch, in response to two bobbin demand signals, for simultaneously supplying two spinning bobbins, one in each of the branched chutes; and moving menas for moving said movable stoppers in an alternating manner for alternately releasing the bobbin stopped in one of said branched chutes with the bobbin stopped in the other of said branched chutes.

9. A system for supplying spinning bobbins doffed from first and second machine beds of a spinning machine to a winder, comprising:

a transporting passage for transporting spinning bobbins to said winder;

a bobbin supplying station for supplying spinning bobbins doffed from said first and second machine beds to said transporting passage;

control means for controlling the supplying of bobbins by said bobbin supplying means so as to alternate the supplying of a spinning bobbin doffed from said first machine bed with a spinning bobbin doffed from said second machine bed.

10. A method for supplying spinning bobbins doffed from first and second machine beds of a spinning machine to a winder, comprising the step of:

alternating the supplying of a single spinning bobbin doffed from one of said first and second machine beds with the supplying of a single spinning bobbin doffed from the other of said first and second machine beds.

11. A method for supplying spinning bobbins doffed from first an second machine beds of a spinning machine to a winder, comprising the steps of:

providing a first spinning bobbin demand signal;

supplying a spinning bobbin doffed from said first machine bed to said winder, in response to said first spinning bobbin demand signal;

providing a second spinning bobbin demand signal;

supplying a spinning bobbin doffed from said second machine bed to said winder, in response to said second spinning bobbin demand signal.

12. A system as claimed in claim 9, further comprising:

first and second transport bands, disposed adjacent said first and second machine beds, respectively, for transporting spinning bobbins doffed from said first and second machine beds to said bobbin supplying station; and drive means for driving each of said first and second transport bands by one pitch, whereby one spinning bobbin doffed from each of said first and second machine beds is transported to said bobbin supplying station.

13. A system as claimed in claim 12, wherein said control means comprises means for controlling the driving of said first and second transport bands so as to alternate the driving of said first transport band by one pitch with the driving of said second transport band by one pitch.

14. A system as claimed in claim 12, wherein said control means comprises:

receiving means for receiving a spinning bobbin driven by said first transport band and a spinning bobbin driven by said second transport band;

discharge means for alternating the discharge of a spinning bobbin driven by said first transport band with a spinning bobbin driven by said second transport band, from said receiving means.

15. A system as claimed in claim 9, further comprising:

signalling means for providing a bobbin demand signal;

wherein said bobbin supplying station supplies a spinning bobbin in response to said bobbin demand signal.

16. A spinning winder, comprising:

a spinning machine for producing spinning bobbins;

a winder having at least one winding unit operable for winding spinning bobbins;

a bobbin supplying station for supplying spinning bobbins produced by said spinning machine to said winder;

a sensor for detecting the absence of a bobbin at said bobbin supplying station; and supplying means for supplying a bobbin produced by said spinning machine to said bobbin supplying station in response to the absence of a bobbin at said bobbin supplying station.

17. A spinning winder, comprising:

a spinning machine having first and second machine beds for producing spinning bobbins from empty bobbins;

a winder having at least one winding unit operable for winding spinning bobbins and for discharging empty bobbins;

a first bobbin transport system operable for alternatingly transporting a spinning bobbin produced by said first machine bed with a spinning bobbin produced by said second machine bed to said winder a second bobbin transport system operable for alternating transporting of an empty bobbin discharged from said winder to said second machine bed with transporting of an empty bobbin discharged from said winder to said first machine bed.

18. A spinning winder as claimed in claim 17 characterized in that said second bobbin transport system is operated to transport an empty bobbin to said second machine bed simultaneously with the operation of said first bobbin transport system to transport a spinning bobbin produced by said first machine bed.

19. A spinning winder as claimed in claim 17 characterized in that said second bobbin transport system is operated to transport an empty bobbin to said first machine bed simultaneously with the operation of said first bobbin transport system to transport a spinning bobbin produced by said second machine bed to said winder.

* * * * *